US008261477B1

(12) United States Patent
Wilkinson et al.

(10) Patent No.: US 8,261,477 B1
(45) Date of Patent: Sep. 11, 2012

(54) LABEL

(75) Inventors: Mike Wilkinson, Overland Park, KS (US); Corey Deters, Gardner, KS (US); Thomas Paul Eversole, Saint Joseph, MI (US)

(73) Assignee: Vestcom New Century LLC, New Century, KS (US)

( * ) Notice: Subject to any disclaimer, the term of this patent is extended or adjusted under 35 U.S.C. 154(b) by 275 days.

(21) Appl. No.: 12/436,684

(22) Filed: May 6, 2009

Related U.S. Application Data

(60) Provisional application No. 61/051,241, filed on May 7, 2008, provisional application No. 61/052,017, filed on May 9, 2008.

(51) Int. Cl.
*G09F 3/10* (2006.01)

(52) U.S. Cl. ..... 40/638; 283/81

(58) Field of Classification Search ..... 40/638, 40/661.03, 661.09; 283/81
See application file for complete search history.

(56) References Cited

U.S. PATENT DOCUMENTS

| | | | | |
|---|---|---|---|---|
| 1,714,265 | A | | 5/1929 | Gurwick |
| 1,802,554 | A | | 4/1931 | Hahn |
| 1,818,459 | A | | 8/1931 | Bryan |
| 1,975,350 | A | | 10/1934 | Davis |
| 3,022,207 | A | | 2/1962 | Lang |
| 3,032,463 | A | | 5/1962 | Morgan |
| 3,295,654 | A | | 1/1967 | Clinton et al. |
| 3,593,659 | A | | 7/1971 | Brackett |
| 3,749,626 | A | | 7/1973 | Buck |
| 3,836,139 | A | | 9/1974 | Shimizu |
| 3,854,229 | A | * | 12/1974 | Morgan ..... 40/638 |
| 3,869,983 | A | | 3/1975 | Garber et al. |
| 3,899,946 | A | | 8/1975 | Niepmann |
| 3,956,049 | A | | 5/1976 | Johnsen |
| 3,995,791 | A | | 12/1976 | Schoppee |
| 3,997,384 | A | | 12/1976 | Kuring et al. |
| 4,014,535 | A | | 3/1977 | Kleid et al. |
| 4,081,309 | A | | 3/1978 | Jenkins |
| 4,463,942 | A | | 8/1984 | Newsome |
| 4,594,125 | A | | 6/1986 | Watson |
| 4,627,605 | A | | 12/1986 | Roller et al. |
| 4,676,159 | A | | 6/1987 | Nawrath |
| 4,724,166 | A | | 2/1988 | deBruin |
| 4,742,741 | A | | 5/1988 | Hallberg et al. |
| 4,756,790 | A | | 7/1988 | Kinnunen |
| 4,758,456 | A | | 7/1988 | Muscala |
| 4,872,707 | A | | 10/1989 | deBruin |

(Continued)

OTHER PUBLICATIONS

U.S. Appl. No. 11/670,284, filed Feb. 2007.

(Continued)

*Primary Examiner* — Gary Hoge
(74) *Attorney, Agent, or Firm* — Lathrop & Gage LLP

(57) ABSTRACT

The present invention relates generally to labeling, and particularly to retail shelf labels and methods of making the same. A sheet having a retail shelf label according to an embodiment includes a liner, a transparent face layer, and a cover layer having graphics printed thereon. Adhesive couples the face layer atop the liner, and adhesive couples the cover layer atop the face layer. Cut lines in the face and cover layers define a perimeter of the label, and a cut line in the cover layer separates the cover layer into two distinct portions respectively separable from the face layer. At least a portion of the adhesive coupled to the face layer inside the label perimeter releases from the liner to removably couple the label to a shelf edge.

8 Claims, 11 Drawing Sheets

U.S. PATENT DOCUMENTS

| | | | | |
|---|---|---|---|---|
| 4,882,004 | A | 11/1989 | Watson | |
| 4,925,520 | A | 5/1990 | Beaudoin et al. | |
| 5,019,436 | A | 5/1991 | Schramer et al. | |
| 5,227,004 | A | 7/1993 | Belger | |
| 5,238,272 | A | 8/1993 | Taylor | |
| 5,343,647 | A * | 9/1994 | Bulka | 40/630 |
| 5,518,329 | A | 5/1996 | Beaudry | |
| 5,702,127 | A | 12/1997 | Korondi, Jr. | |
| 5,704,648 | A | 1/1998 | Brown et al. | |
| 5,709,472 | A | 1/1998 | Prusik | |
| 5,778,782 | A | 7/1998 | Behringer et al. | |
| 5,806,418 | A | 9/1998 | Dillinger | |
| 5,847,378 | A | 12/1998 | Goodwin et al. | |
| 5,958,536 | A | 9/1999 | Geisinger et al. | |
| 6,026,727 | A | 2/2000 | Meeks | |
| 6,105,295 | A | 8/2000 | Brinkman et al. | |
| 6,123,796 | A | 9/2000 | Kathmann et al. | |
| 6,235,376 | B1 | 5/2001 | Miyazaki et al. | |
| 6,306,476 | B1 | 10/2001 | Barry | |
| 6,364,990 | B1 | 4/2002 | Grosskopf | |
| 6,432,500 | B1 * | 8/2002 | Jones et al. | 428/40.1 |
| 6,531,258 | B1 | 3/2003 | Rieger et al. | |
| 6,578,875 | B2 * | 6/2003 | Tamura et al. | 283/114 |
| 6,579,585 | B1 | 6/2003 | Garvic et al. | |
| 6,595,131 | B2 | 7/2003 | Armstrong | |
| 6,632,316 | B1 | 10/2003 | Garvic | |
| 6,637,650 | B1 | 10/2003 | Capurso et al. | |
| 6,685,228 | B2 | 2/2004 | Riley | |
| 6,848,205 | B2 | 2/2005 | Rieger et al. | |
| 6,863,311 | B2 | 3/2005 | Riley | |
| 6,926,942 | B2 | 8/2005 | Garvic et al. | |
| 2002/0114936 | A1 | 8/2002 | Kong | |
| 2003/0061750 | A1 * | 4/2003 | Bernier et al. | 40/638 |
| 2003/0072976 | A1 | 4/2003 | Sanford | |
| 2004/0050941 | A1 | 3/2004 | Hanyu et al. | |
| 2004/0154203 | A1 * | 8/2004 | Bredow et al. | 40/638 |
| 2005/0022434 | A1 * | 2/2005 | Kimble et al. | 40/312 |
| 2005/0193609 | A1 * | 9/2005 | Schwartz | 40/638 |
| 2005/0206586 | A1 | 9/2005 | Capurso et al. | |
| 2006/0010743 | A1 * | 1/2006 | Fowler et al. | 40/638 |
| 2006/0257607 | A1 | 11/2006 | Crooks | |

OTHER PUBLICATIONS

U.S. Appl. No. 11/686,481, filed Mar. 7, 2007.

U.S. Appl. No. 11/671,737, filed Feb. 6, 2007.

U.S. Appl. No. 12/436,663, filed May 6, 2009.

Office Action issued Jul. 27, 2011, U.S. Appl. No. 12/436,663. 9 pages.

* cited by examiner 100
102a
150
155a
151a
151
130
151b
155b
154b 100
110
170
150
114a
120
112a
121a
102a
125a
130
102a
114b
116b 100
102a
120
114a
116a
121a
130

LABEL

CROSS-REFERENCE TO RELATED APPLICATIONS

This application is related to and claims the benefit of pending U.S. Provisional Patent Application No. 61/051,241, filed on May 7, 2008, and entitled "Label", the entire contents of which are incorporated herein by reference. This application is also related to and claims the benefit of pending U.S. Provisional Patent Application No. 61/052,017, filed on May 9, 2008, and entitled "Label", the entire contents of which are incorporated herein by reference.

BACKGROUND

The present invention relates generally to labeling, and in particular to retail shelf labels and methods of making the same.

Printed labels comprise an important form of communication. Labels are commonly used for conveying information in a wide range of applications. In the retail sector, for example, labels are commonly applied to product displays (i.e., "point-of-sale" displays) to identify objects and to convey information about those objects to customers. Retail establishments may employ various types of labels to communicate such product information as pricing, product identification, etc.

In retail establishments, product information tends to be dynamic in that product offerings and pricing undergo frequent changes. Point-of-sale product labeling is often changed by applying new labels to shelves on which the products are displayed. Such shelf labeling is a significant part of the labeling activity in retail commercial establishments.

Labels and manufacturing methods set forth herein include novel improvements to the prior art labels and manufacturing methods, as will be evident from reviewing the description below and the accompanying drawings.

SUMMARY

A sheet having a retail shelf label according to an embodiment includes a liner, a transparent face layer, and a cover layer having graphics printed thereon. Adhesive couples the face layer atop the liner, and adhesive couples the cover layer atop the face layer. Cut lines in the face and cover layers define a perimeter of the label, and a cut line in the cover layer separates the cover layer into two distinct portions respectively separable from the face layer. At least a portion of the adhesive coupled to the face layer inside the label perimeter releases from the liner to removably couple the label to a shelf edge.

DETAILED DESCRIPTION

Figures 1, 2, 3:
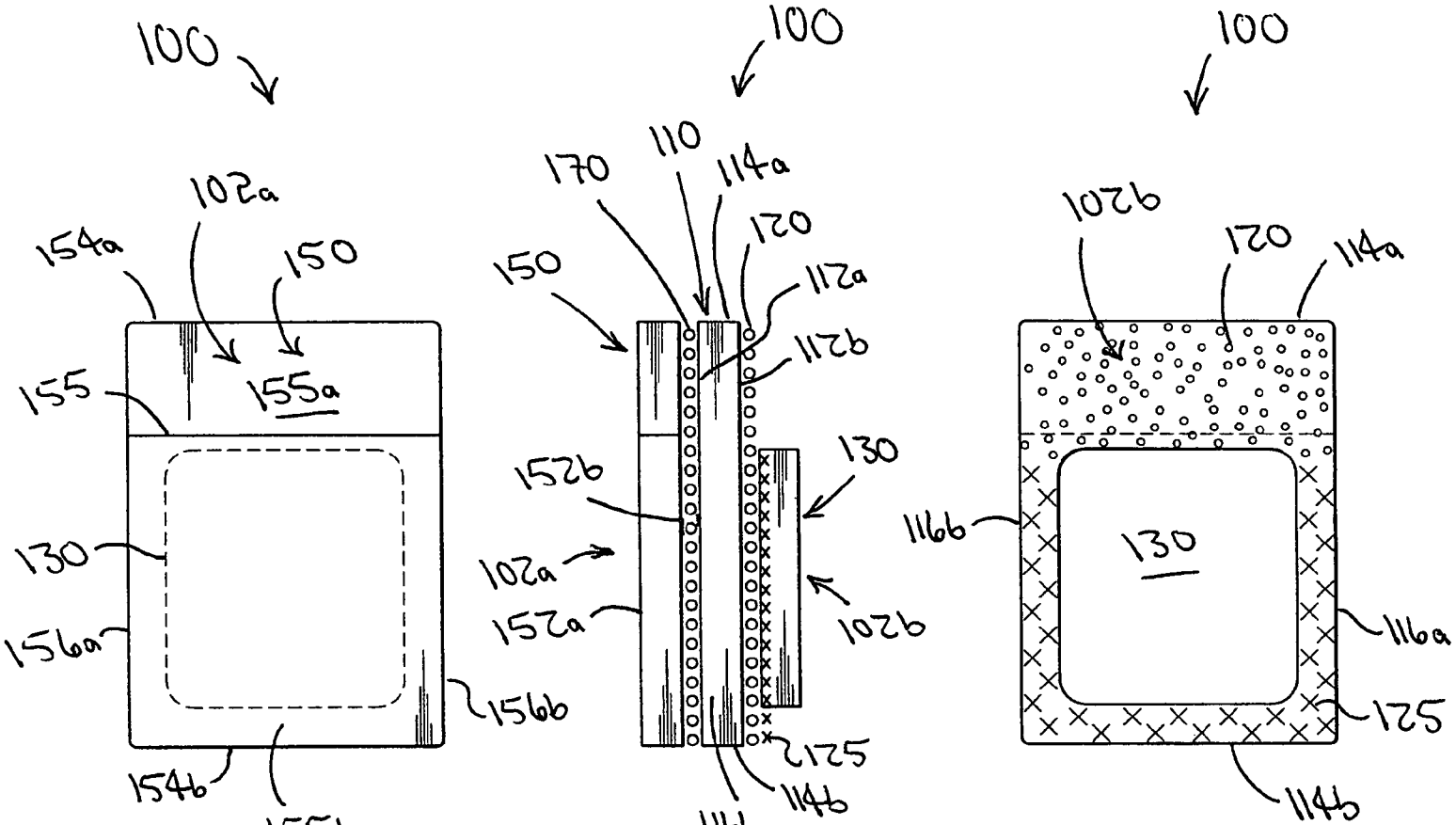
FIG. 1 is a front view of a label according to an embodiment, with graphics on the cover omitted.
FIG. 2 is a side view of the label of FIG. 1.
FIG. 3 is a rear view of the label of FIG. 1.

FIGS. 1 through 6 show an embodiment of a new label 100. The label 100 has front and rear sides 102*a*, 102*b* and includes a face layer 110, a liner 130, and a cover 150. The face layer 110 has outer and inner sides 112*a*, 112*b*, upper and lower ends 114*a*, 114*b*, and opposed sides 116*a*, 116*b* and may be constructed of vinyl and/or any other suitable material. While the ends and sides 114*a*, 114*b*, 116*a*, 116*b* of the presentation face layer 110 are shown to collectively be generally rectangular, non-rectangular configurations may alternately be defined. Material for face layer 110 may be chosen for transparency, printability, durability, and/or other properties that are required or suitable for particular applications.

Figure 4:
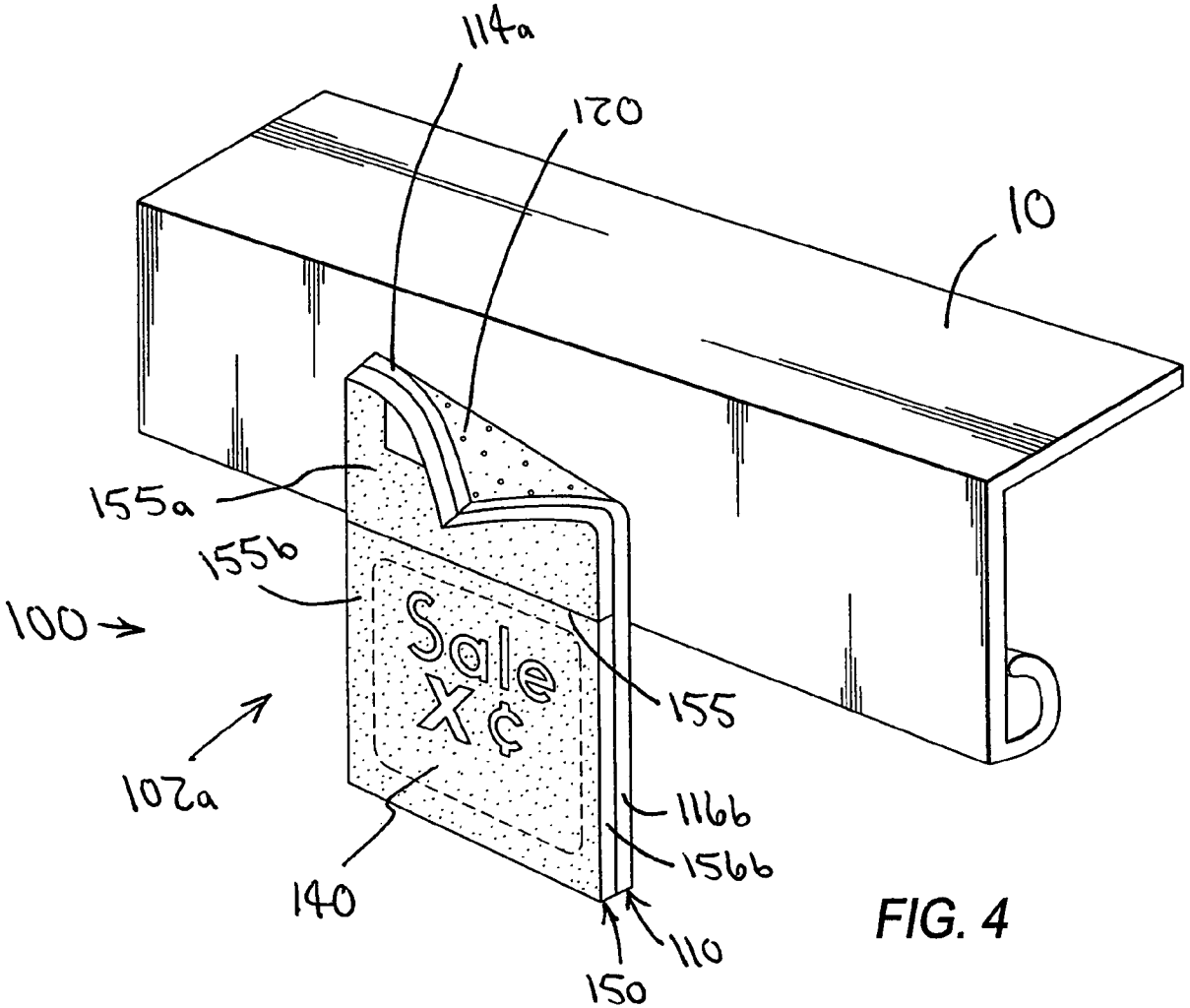
FIG. 4 is a front perspective view of the label of FIG. 1, the label being coupled to a shelf according to an embodiment.
Figure 6:
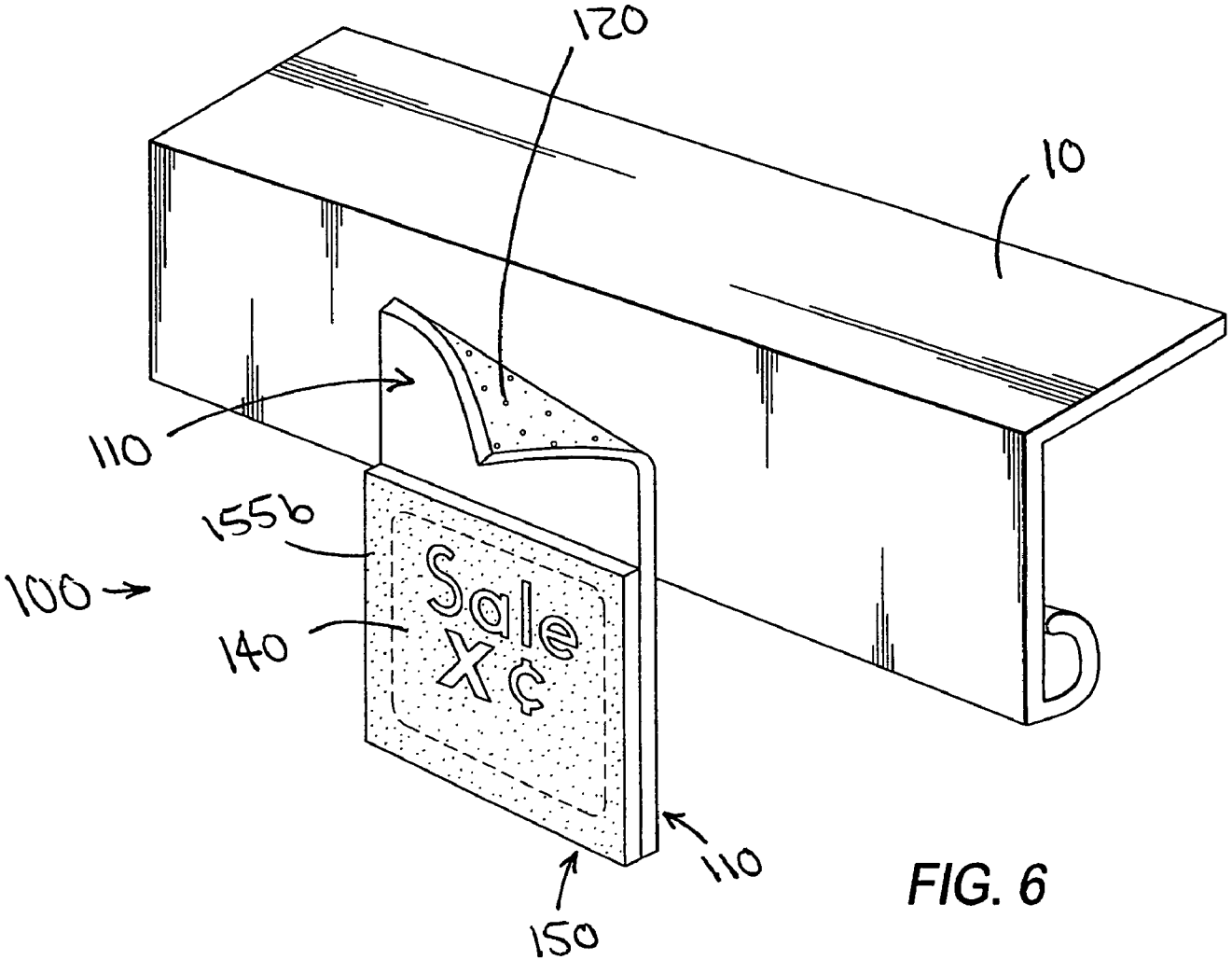
FIG. 6 is a front perspective view of the label of FIG. 1, the label being coupled to a shelf according to an embodiment.
Figure 7A:
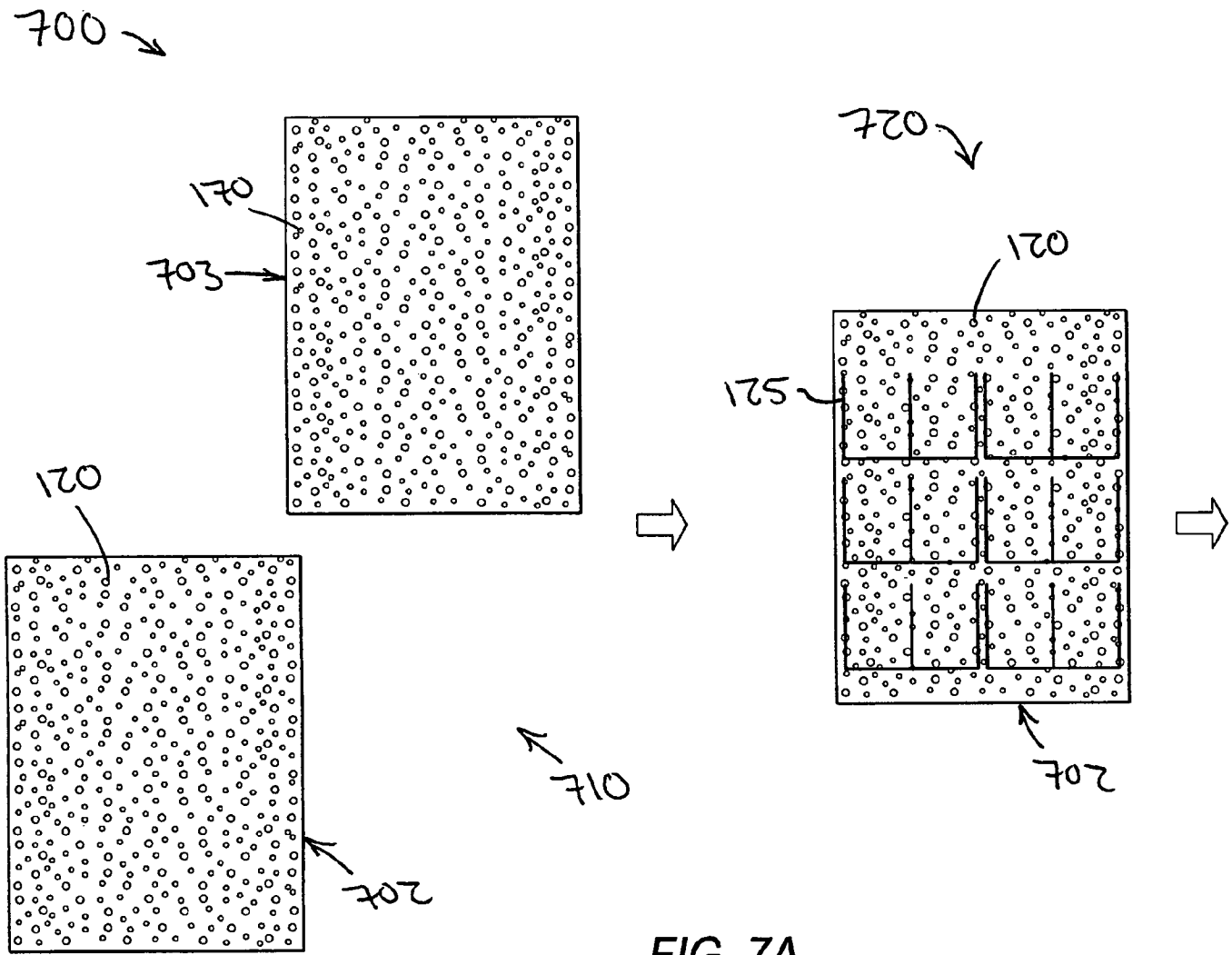
FIGS. 7A through 7D collectively show a diagram representing a manufacturing process for a sheet of the labels of FIG. 1, according to an embodiment.
Figure 7B:
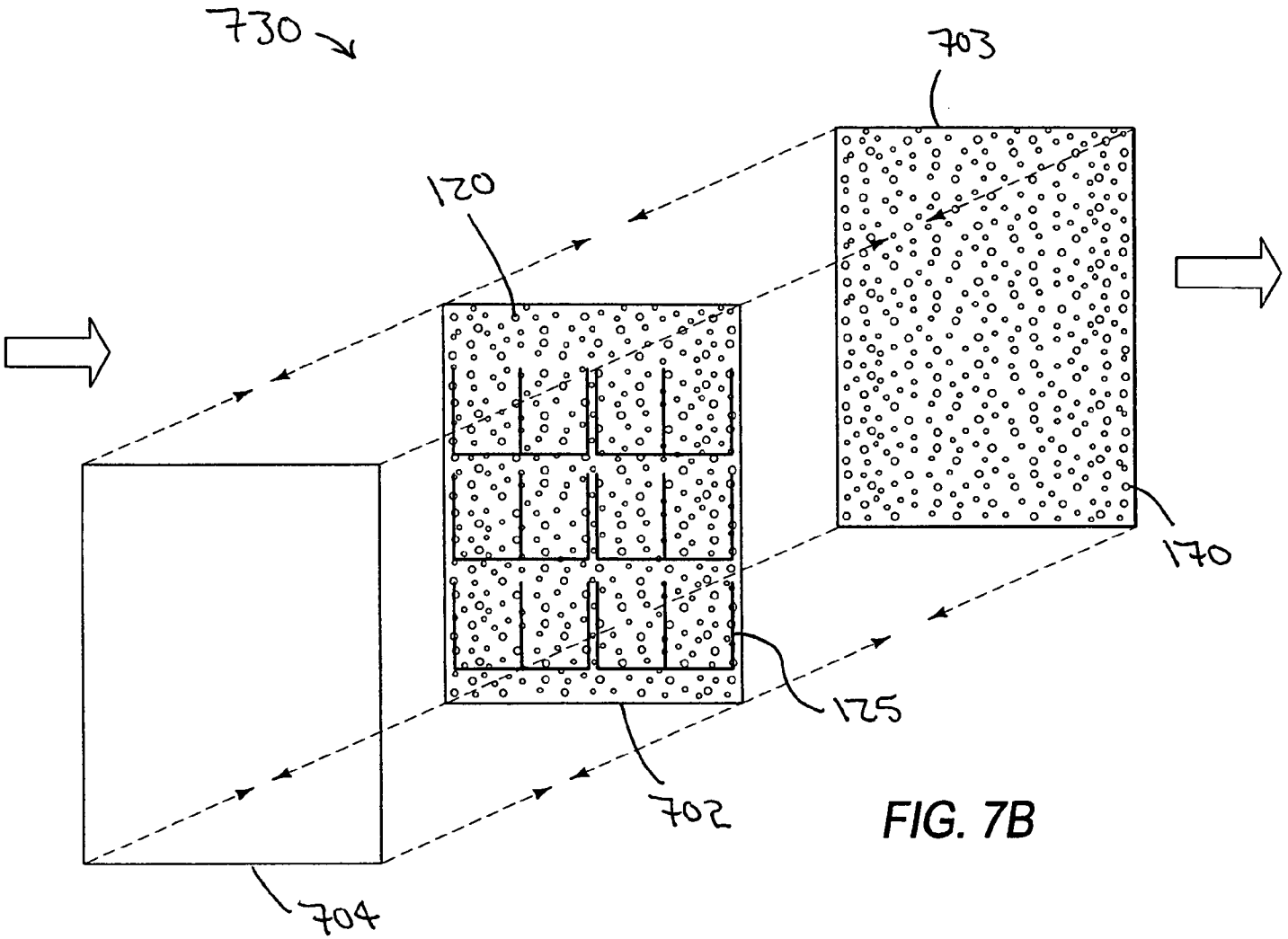
Figure 7D:
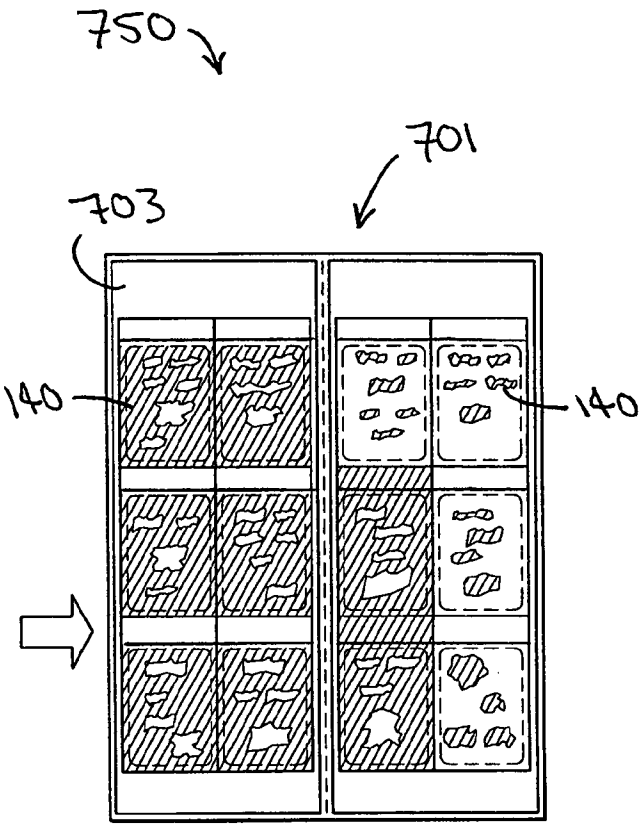
Figure 7C:
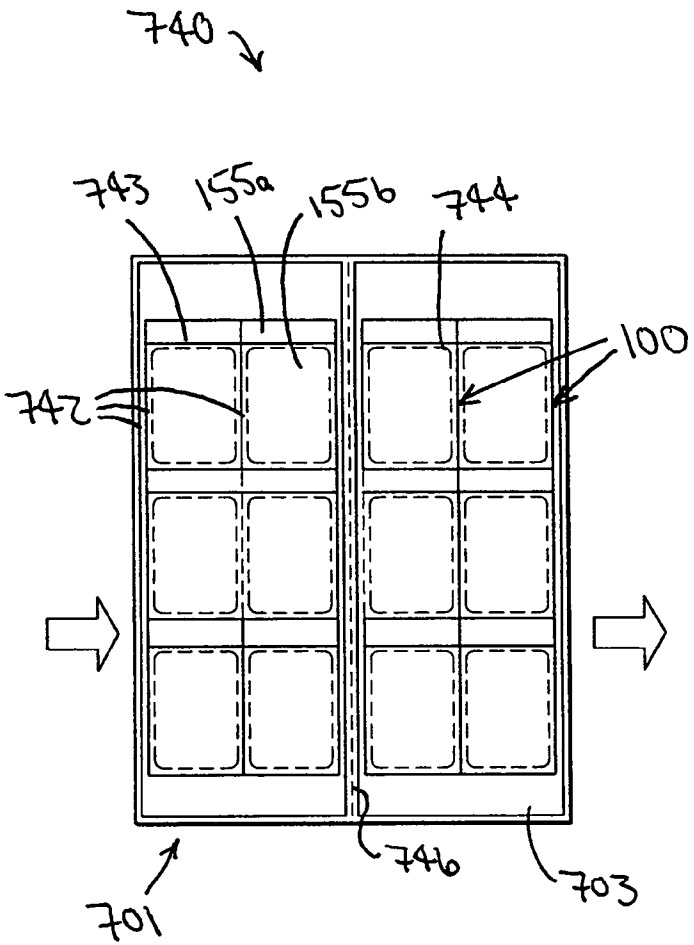

The face layer inner side 112*b* includes an adhesive material 120 which may be used to couple the face layer 110 to the shelf edge 10 and which may couple the face layer 110 to the liner 130. The adhesive material 120 may comprise any suitable pressure-sensitive, self-adhesive material, such as acrylic adhesive, which is releasable for repositioning purposes and which leaves little or no residue. Acrylic adhesive has a further advantage of not being susceptible to melting during printing operations, such as in laser printers. In FIGS. 4 and 6, a corner of the face layer 110 is separated from the shelf 10 to show the adhesive material 120.

Figure 5:
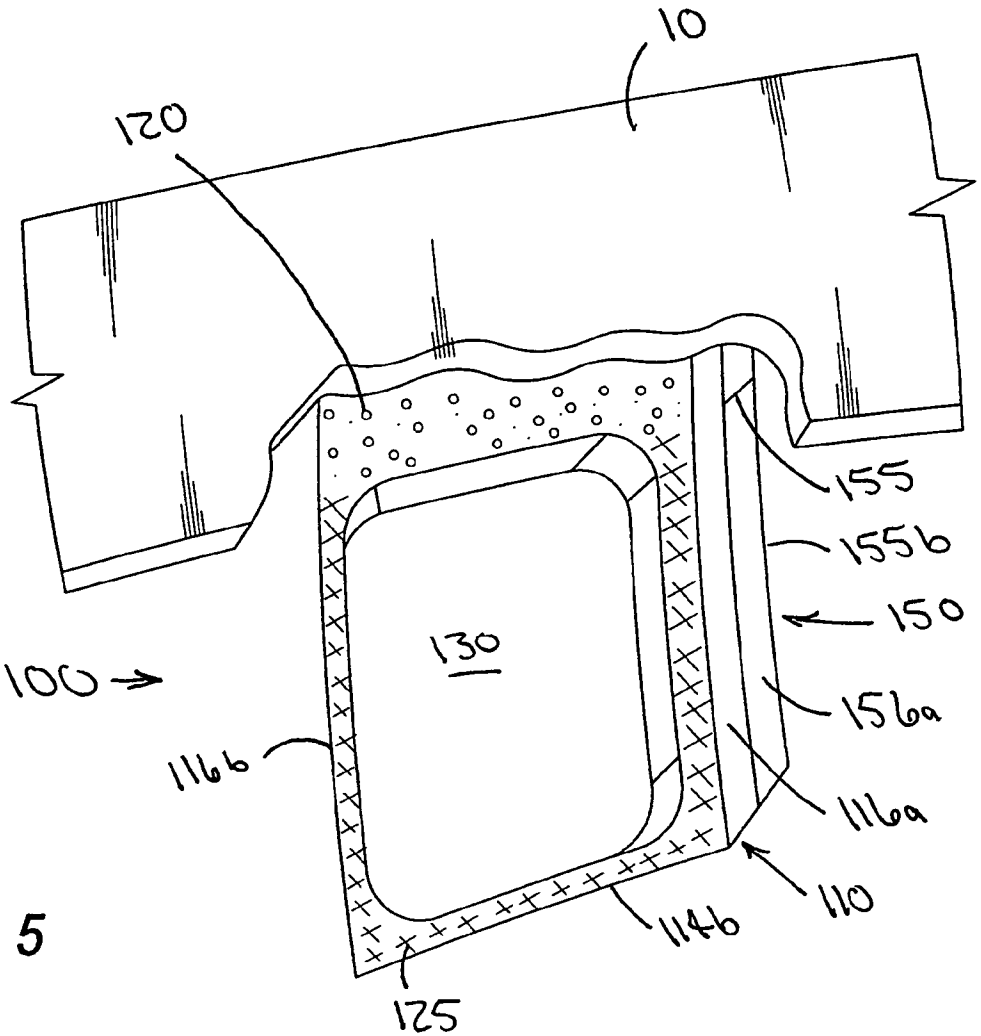
FIG. 5 is a rear perspective view of FIG. 4.

An adhesive deadening agent 125 may extend over the adhesive material 120 along the lower end 114*b* of the face layer 110 and/or along a portion of each side 116*a*, 116*b* of the face layer 110 to neutralize the adhesive material 120 in those areas. For example, as shown in FIG. 3 and FIG. 5, the deadening agent 125 extends between the lower end 114*b* of the face layer 110 and the liner 130, between the side 116*a* of the face layer 110 and the liner 130, and between the side 116*b* of the face layer 110 and the liner 130.

The deadening agent 125 may further extend between the face layer 110 and the liner 130 (i.e., sandwiched between the face layer 110 and the liner 130) near the perimeter of the liner 130 so that tolerances for applying the deadening agent 125 may be increased. However, if the adhesive 120 is used to couple the face layer 110 to the liner 130, it may be preferable for the deadening agent 125 to not extend between the face layer 110 and the liner 130 to an extent that the face layer 110 is not coupled to the liner 130. It may be undesirable for the deadening agent 125 to extend between the face layer 110 and the liner 130 to an extent that allows the perimeter of the liner 130 to separate from the face layer 110 and allows the liner 130 and the face layer 110 to become visibly curled away from one another.

The cover 150 has outer and inner sides 152*a*, 152*b*, upper and lower ends 154*a*, 154*b*, and opposed sides 156*a*, 156*b* and may be constructed of paper and/or any other suitable material. The cover 150 may be cut (represented by cut line 155) to separate the cover 150 into two portions 155*a*, 155*b*. While the ends and sides 154*a*, 154*b*, 156*a*, 156*b* of the cover 150 are shown to collectively be generally rectangular, non-rectangular configurations may alternately be defined. In at least one embodiment, the perimeter of the cover 150 generally corresponds to the perimeter of the face layer 110. Material for cover 150 may be chosen for printability, durability, and/or other properties that are required or suitable for particular applications.

The cover inner side 152*b* includes an adhesive material 170 which may be used to couple the cover 150 to the face layer 110 (i.e., to the face layer outer side 112*a*). The adhesive material 170 may or may not be the same as the adhesive 120 and may comprise any suitable pressure-sensitive, self-adhesive material, such as acrylic adhesive, which is releasable for repositioning purposes and which leaves little or no residue. Acrylic adhesive has a further advantage of not being susceptible to melting during printing operations, such as in laser printers.

The cover 150 may include graphics 140 viewable from the label front side 102*a*. The graphics 140 (FIGS. 4 and 6) may be printed on the cover 150 using a laser printer, a dot matrix printer, or any other appropriate method or device. Additionally, the face layer 110 may include graphics. If the cover 150 is transparent, the graphics 140 on the cover 150 and the graphics on the face layer 110 may be viewed when the cover 150 is attached to the face layer 110. If the cover 150 is not transparent, the graphics on the face layer 110 may be viewed when the cover 150 (or a portion of the cover 150, e.g., portion 155*b*) is separated from the face layer 110.

By including the liner 130, graphics viewable from the label front side 102*a* may be at least partially created or accented by the liner 130 if the face layer 110 is transparent and viewable from the label front side 102*a*. In other words, if graphics are printed around certain indicia on the face layer 110, the appearance of the graphics and/or the indicia may be affected by the color of the liner 130. For example, if the face layer 110 is clear (or substantially clear), and graphics are printed on the face layer 110, the absence of print at the indicia allows the indicia to substantially be the color of the liner 130 (e.g., white). Further, the liner 130 may enhance the graphics by making the label 100 less transparent from the front side 102*a*. Transparency has been a problem experienced in the prior art, in that certain colors have sometimes been difficult to read while prior art labels are in use. In addition, prior art transparent labels have been unable to effectively utilize certain colors (e.g., white). It should also be appreciated that the label 100 may incorporate an extra color than prior art transparent labels without using an extra color of ink, which can provide a substantial cost savings. It should further be understood that, in some embodiments, graphics may be printed on the liner 130 and visible through the face layer 110.

If a transparent material is used for the face layer 110 and the face layer 110 is viewable from the label front side 102*a*, information on the shelf edge 10 (e.g., a previous label having product or price information) may be viewed while the label 100 is coupled to the shelf edge 10. This may be desirable, for example, to show a product's original price if it is currently on sale, or to avoid having to print a barcode for the product on the label 100.

In use, the adhesive material 120 may be used to couple the face layer 110 to the shelf 10. As shown in FIGS. 4 and 5, the cover 150 may remain attached to the face layer 110 and present the graphics 140. As shown in FIG. 6, the portion 155*a* of the cover 150 may be removed from the face layer 110, and a portion of the face layer 110 may be viewable from the label front side 102*a*. If the face layer 110 is transparent, a previous label on the shelf 10 may be viewed, allowing a customer to easily make comparisons between information on the label 100 and the previous label. This may also eliminate the need for a product's barcode or other static data to be printed on the label 100. Though not shown, the entire cover 150 may be removed from the face layer 110. If the portion 155*a* of the cover 150 is removed from the face layer 110, the portion 155*a* may be used independently as a label (e.g., coupled to the shelf 10).

One manufacturing process 700 for a sheet 701 of the labels 100 is shown in FIG. 7A through FIG. 7D. At step 710, the adhesive 120 is applied to the material 702 that forms the face layer 110, and the adhesive 170 is applied to the material 703 that forms the cover 150. The adhesive 120 may be applied to the face material 702 in any suitable manner at the same facility where other manufacturing steps described herein are performed, or the face material 702 may be purchased having the adhesive 120 and coupled to the material 704 that forms the liner 130, and, to add the deadening agent 125, the face material 702 may be separated from the liner material 704 as set forth in U.S. Pat. Nos. 6,579,585 and 6,926,942, the contents of which are incorporated herein by reference. The process 700 proceeds from step 710 to step 720.

At step 720, the deadening agent 125 is applied to areas that correspond to the areas of the individual labels 100 having deadening agent 125 as discussed above. The process 700 proceeds from step 720 to step 730, where the face material 702 is coupled to the liner material 704 and the cover material 703 is coupled to the face material 702. The process 700 proceeds from step 730 to step 740.

At step 740, the cover material 703 and the face material 702 may be cut through (represented by cut lines 742) to define the individual covers 150 and face layers 110 for the individual labels 100; the cover material 703 may be cut through (represented by cut lines 743) to define the two portions 155*a*, 155*b* of each individual label 100; the liner material 704 may be cut through (represented by cut lines 744) to define the individual liners 130 for the individual labels 100; and the cover material 703, the face material 702, and the liner material 704 may be perforated (represented by perforation line 746) to allow the sheet 701 to be separated into multiple portions.

If the face material 702, the cover material 703, and/or the liner material 704 are provided in rolls, the material(s) may be cut into the sheet 701. In at least one embodiment, no cut line 742 intersects or overlaps a cut line 744. It should be understood that step 740 may actually be accomplished in multiple steps, and that the order of cutting and perforating is generally not critical. The process 700 proceeds from step 740 to step 750.

At step 750, graphics 140 are printed on the cover material 703 using a laser printer, a dot matrix printer, or any other appropriate method or device. Step 750 may be performed before the sheet 701 is delivered to the end user, or the end user may place the graphics 140 on the cover material 703. Because front and rear sides of the sheet 701 are generally planar and are each formed from a respective single sheet of material, the printing process may be more easily completed than when printing on other labels that have various materials that comprise the front side or the rear side. It should be understood that step 750 may be completed at various times in process 700, such as before step 710, for example. In addition, if graphics are to be printed on the face material 702, those graphics may be printed on the face material 702 using a laser printer, a dot matrix printer, or any other appropriate method or device before step 730, for example.

Figure 10:
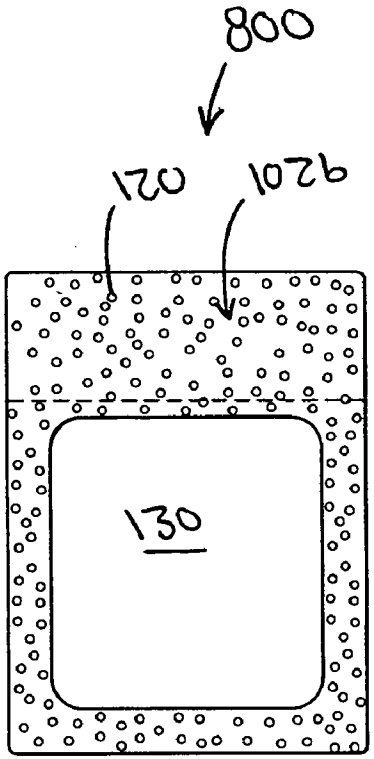
FIG. 10 is a rear view of the label of FIG. 8.
Figure 9:
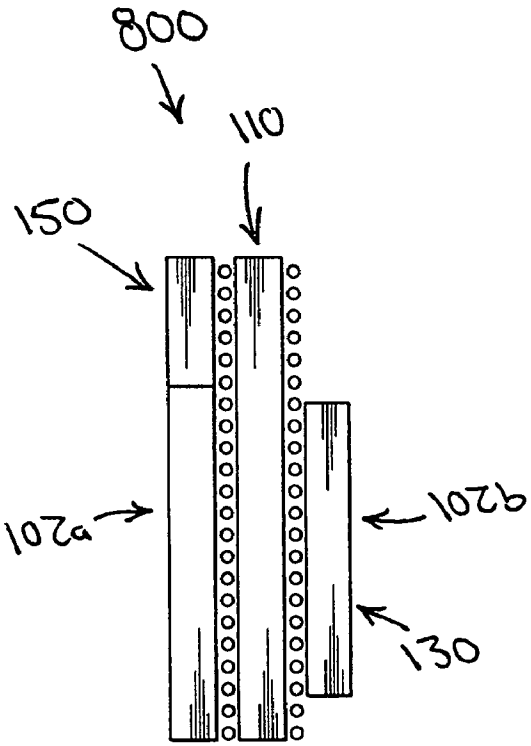
FIG. 9 is a side view of the label of FIG. 8.
Figure 8:
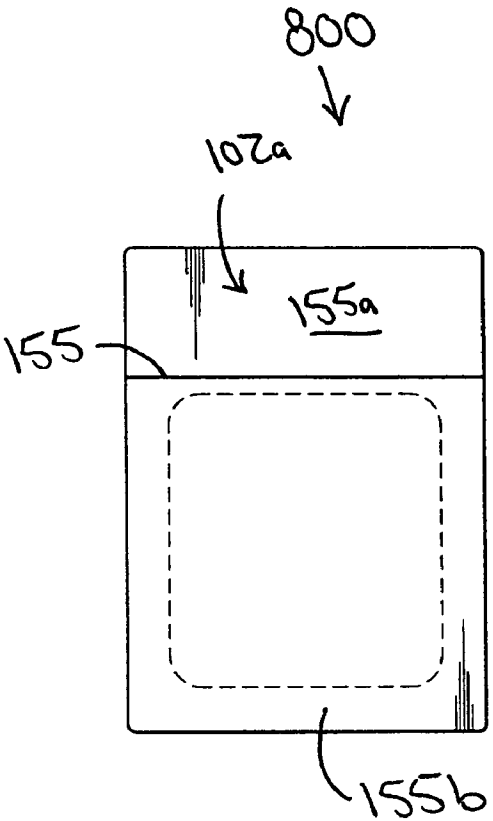
FIG. 8 is a front view of a label according to another embodiment.

In another embodiment, shown in FIG. 8, FIG. 9, and FIG. 10, a label 800 is substantially similar to label 100, and similar elements are referenced by the same reference numbers used in relation to label 100 above. In label 800, deadening agent 125 is omitted.

Figure 11:
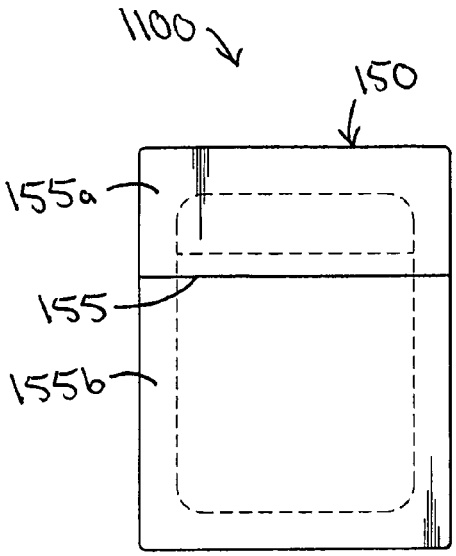
FIG. 11 is a front view of a label according to still another embodiment, with graphics on the cover omitted.
Figure 12:
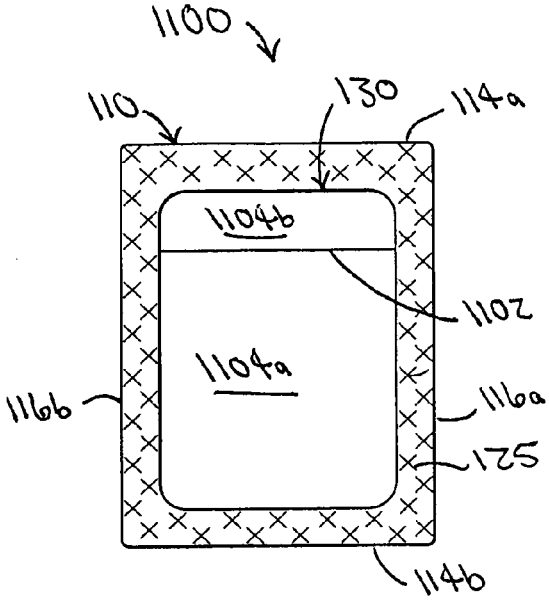
FIG. 12 is a rear view of the label of FIG. 11.

In another embodiment, shown in FIG. 11 and FIG. 12, a label 1100 is substantially similar to label 100, and similar elements are referenced by the same reference numbers used in relation to label 100 above. In label 1100, the liner 130 extends closer to upper end 114*a* of the face layer 110, and the liner 130 is cut (represented by cut line 1102) to separate the liner 130 into two portions 1104*a*, 1104*b*. Portion 1104*a* may be of generally similar size or proportion as the liner 130 of label 100, and portion 1104*b* may generally correspond to the amount the liner 130 is extended when compared to label 100.

In label 1100, the adhesive deadening agent 125 further extends over the adhesive material 120 along the upper end 114*a* of the face layer 110, and more particularly, the deadening agent 125 extends between the upper end 114*a* of the face layer 110 and the liner 130. The deadening agent 125 also extends between the side 116*a* of the face layer 110 and the portion 1104*b* of the liner 130 and between the side 116*b* of the face layer 110 and the portion 1104*b* of the liner 130.

Figure 13:
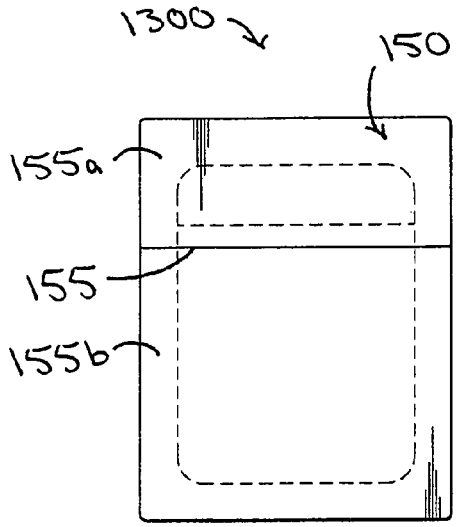
FIG. 13 is a front view of a label according to yet another embodiment, with graphics on the cover omitted.
Figure 14:
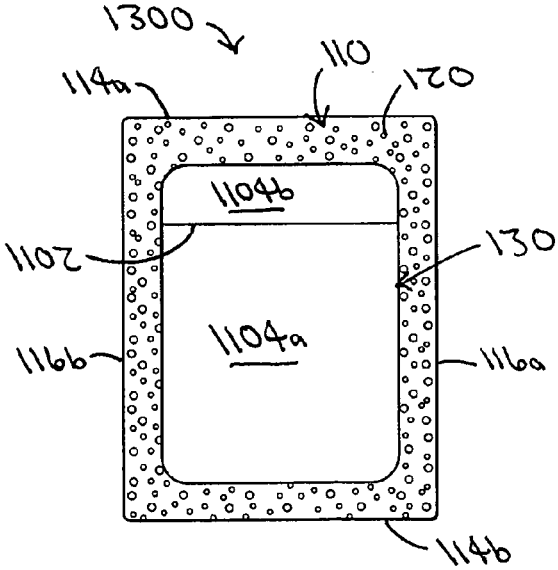
FIG. 14 is a rear view of the label of FIG. 13.

In another embodiment, shown in FIG. 13 and FIG. 14, a label 1300 is substantially similar to label 1100, and similar elements are referenced by the same reference numbers used in relation to label 1100 above. In label 1300, deadening agent 125 is omitted.

Figure 17:
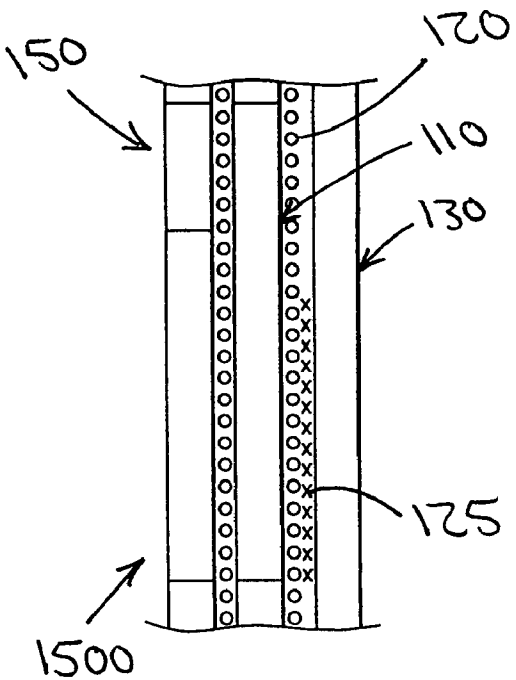
FIG. 17 is a side view of the label of FIG. 15 before the face layer is separated from the liner.
Figure 16:
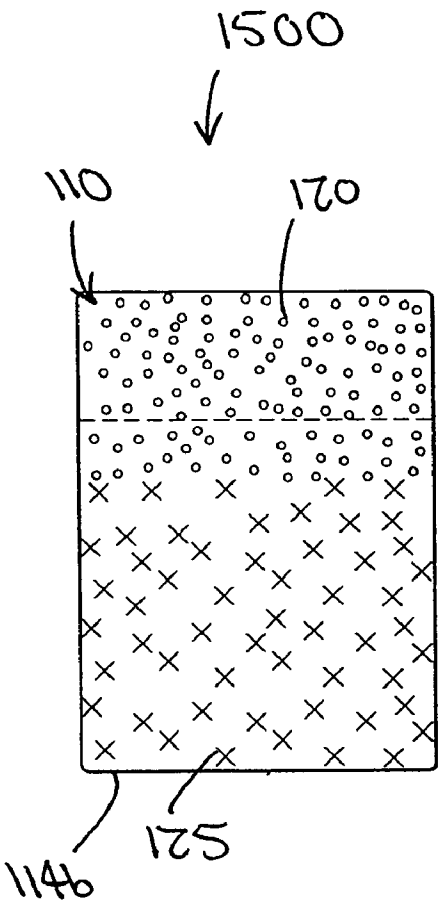
FIG. 16 is a rear view of the label of FIG. 15.
Figure 15:
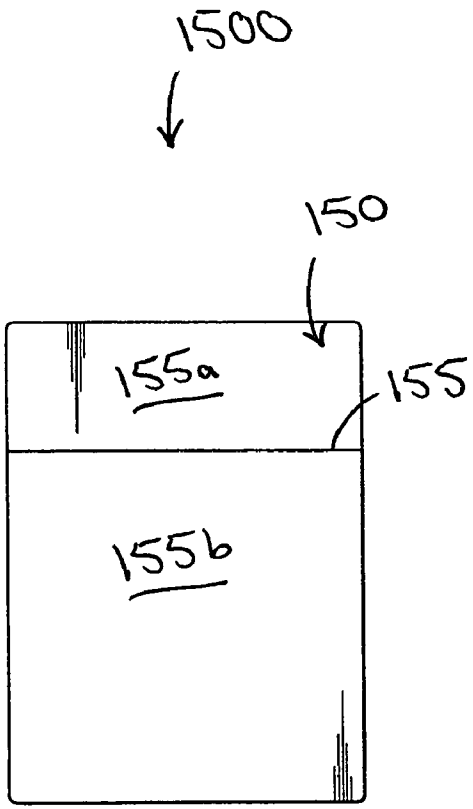
FIG. 15 a front view of a label according to still yet another embodiment, with graphics on the cover omitted.

In yet another embodiment, shown in FIG. 15, FIG. 16, and FIG. 17, a label 1500 is substantially similar to label 100, and similar elements are referenced by the same reference numbers used in relation to label 100 above. In label 1500, the face layer 110 separates from the liner 130 before use. In other words, no portion of the liner 130 sits adjacent the face layer 110 when the face layer 110 is adhered to a shelf edge (contrast to FIG. 5, for example). A deadening agent 125 extends from the lower end 114*b* such that much of the face layer 110 is not adherent when in use, as shown in FIG. 16, and the cut lines 744 discussed above may be omitted. FIG. 17 shows the label 1500 while the face layer 110 is still coupled to the liner 130 (i.e., before the face layer 110 is adhered to a shelf edge. While the adhesive 120 between the face layer 110 and the liner 130 is shown separated from the liner 130 in FIG. 17, one of ordinary skill in the art will appreciate that, in practice, the adhesive 120 couples the face layer 110 to the liner 130.

Figure 20:
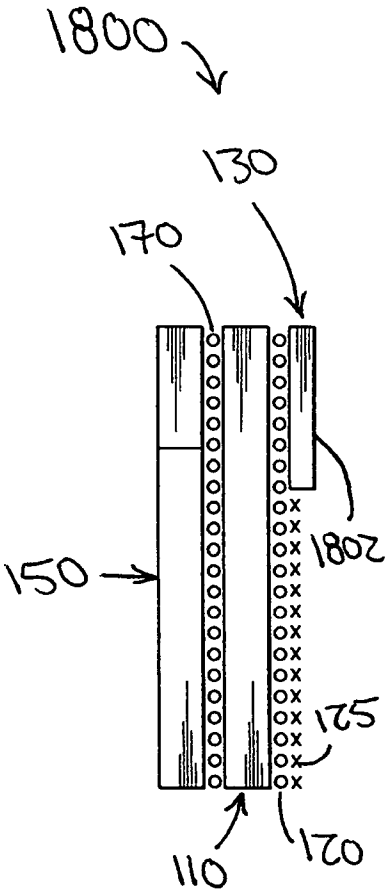
FIG. 20 is a side view of the label of FIG. 18.
Figure 19:
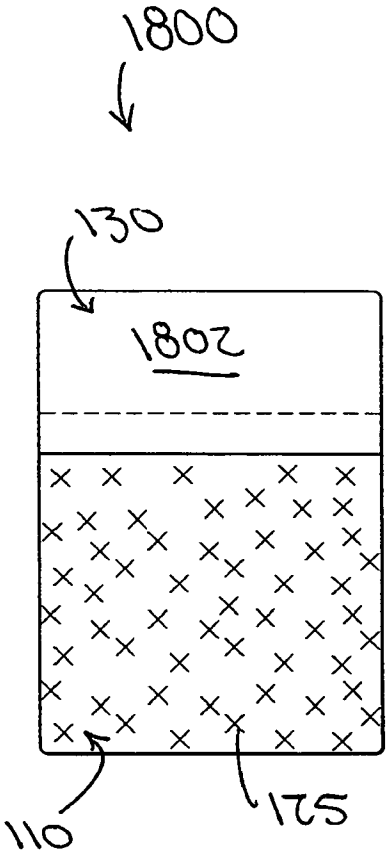
FIG. 19 is a rear view of the label of FIG. 18.
Figure 18:
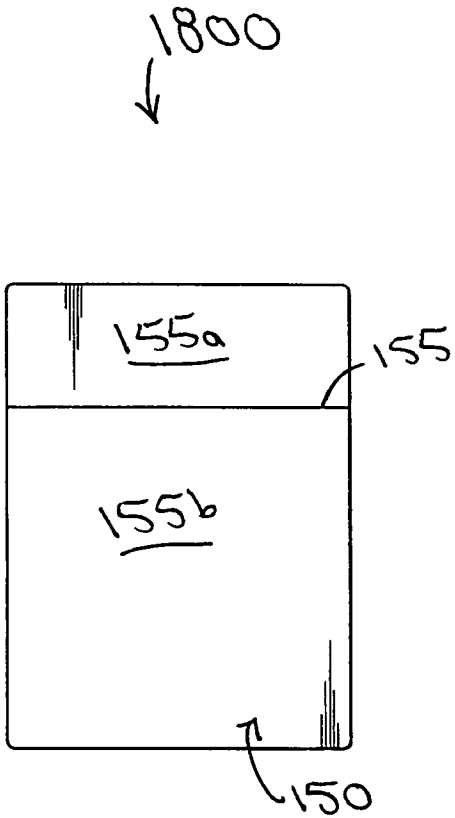
FIG. 18 is a front view of a label according to yet still another embodiment, with graphics on the cover omitted.

In another embodiment, shown in FIG. 18, FIG. 19, and FIG. 20, a label 1800 is substantially similar to label 1500, and similar elements are referenced by the same reference numbers used in relation to label 1500 above. In label 1800, portion 1802 of the liner 130 remains coupled to the face layer 110 until separated immediately before use, when the adhesive 120 is exposed. Like in label 1500, the liner 130 is entirely separated from the face layer 110 while the label 1800 is coupled to a shelf edge.

Those skilled in the art appreciate that variations from the specified embodiments disclosed above are contemplated herein and that the described embodiments are not limiting. The description should not be restricted to the above embodiments, but should be measured by the following claims.

We claim:

1. A sheet having a retail shelf label, comprising:

a liner;

a transparent face layer;

a cover layer having graphics printed thereon;

adhesive coupling the face layer atop the liner;

adhesive coupling the cover layer atop the face layer;

cut lines in the face and cover layers defining a perimeter of the label, the cut lines in the face layer and the cut lines in the cover layer sharing a common configuration such that the cut lines in the cover layer overlay the cut lines in the face layer; and a cut line in the cover layer extending from one point on the perimeter of the label to another point on the perimeter of the label and separating the cover layer into two distinct portions respectively separable from the face layer;

wherein at least a portion of the adhesive coupled to the face layer inside the label perimeter releases from the liner to removably couple the label to a shelf edge.

2. The sheet of claim 1, wherein the perimeter of the label consists of upper and lower ends and opposed sides.

3. A sheet having a retail shelf label, comprising:

a liner;

a transparent face layer;

a cover layer having graphics printed thereon;

adhesive coupling the face layer atop the liner;

adhesive coupling the cover layer atop the face layer;

cut lines in the face and cover layers defining a perimeter of the label; and a cut line in the cover layer separating the cover layer into two distinct portions respectively separable from the face layer;

wherein at least a portion of the adhesive coupled to the face layer inside the label perimeter releases from the liner to removably couple the label to a shelf edge;

wherein the perimeter of the label consists of upper and lower ends and opposed sides;

further comprising cut lines in the liner defining a removable liner area, the removable liner area having a perimeter that corresponds to or is inside the label perimeter; wherein the removable liner area remains coupled to the face layer inside the label perimeter when the label is separated at the label perimeter from a remainder of the face layer and a remainder of the liner.

4. The sheet of claim 3, wherein the perimeter of the removable liner area is inset from the perimeter of the label such that the removable liner area is separated from the upper and lower ends and opposed sides.

5. The sheet of claim 4, further comprising a deadening agent coupled to the adhesive between the removable liner area and the lower end and between the removable liner area and each respective opposed side such that the label is not adhering between the removable liner area and the lower end and between the removable liner area and each respective opposed side.

6. The sheet of claim 5, further comprising a deadening agent coupled to the adhesive between the removable liner area and the upper end such that the label is not adhering between the removable liner area and the upper end.

7. The sheet of claim 3, further comprising a cut line in the liner separating the removable liner area into two distinct portions respectively separable from the face layer.

8. The sheet of claim 3, further comprising graphics printed on at least one of the face layer and the removable liner area.

* * * * *